US006237458B1

(12) United States Patent
Dennison et al.

(10) Patent No.: US 6,237,458 B1
(45) Date of Patent: May 29, 2001

(54) AUTO EQUALIZED DUAL PIERCE UNIT

(75) Inventors: Glenn M. Dennison, Croswell; Michael D. Miller, Marysville; Dean J. Kruger, Jeddo, all of MI (US)

(73) Assignee: BTM Corporation, Marysville, MI (US)

( * ) Notice: Subject to any disclaimer, the term of this patent is extended or adjusted under 35 U.S.C. 154(b) by 0 days.

(21) Appl. No.: 09/211,412

(22) Filed: Dec. 15, 1998

(51) Int. Cl.[7] ..... B26F 1/04

(52) U.S. Cl. ..... 83/519; 83/615; 83/618; 83/623; 83/639.5

(58) Field of Search ..... 83/639.5, 639.1, 83/640, 641, 456, 461, DIG. 2, 513, 368, 519, 553, 622, 618, 615, 623

(56) References Cited

U.S. PATENT DOCUMENTS

| | | | | |
|---|---|---|---|---|
| Re. 34,621 | * | 5/1994 | Waltonen et al. | 83/191 |
| 67,719 | | 8/1867 | Burr | 91/216 |
| 300,174 | | 6/1884 | Webster | 72/407 |
| 788,876 | | 5/1905 | Bêché | 60/370 |
| 1,302,246 | | 4/1919 | Trace | 91/26 |
| 1,452,224 | | 4/1923 | Smith | 83/164 |
| 1,788,298 | | 1/1931 | Hottel | 92/110 |
| 1,875,448 | | 9/1932 | Hanna | 72/407 |
| 2,183,983 | | 12/1939 | Bostwick | 425/395 |
| 2,828,067 | | 3/1958 | Chaffin | 239/174 |
| 3,008,032 | | 11/1961 | Wolfbauer, Jr. | 219/89 |
| 3,043,340 | | 7/1962 | Rehbock | 138/31 |
| 3,182,599 | | 5/1965 | Blakeslee | 103/50 |
| 3,270,604 | | 9/1966 | Waltonen | 83/140 |
| 3,396,260 | | 8/1968 | Waltonen | 219/89 |
| 3,420,148 | | 1/1969 | Doerfer et al. | 92/107 |
| 3,640,167 | * | 2/1972 | Axtmann | 83/380 |
| 3,656,388 | * | 4/1972 | Valente | 83/456 |
| 3,759,130 | | 9/1973 | Patterson | 83/637 |
| 3,897,707 | | 8/1975 | Kruse et al. | 83/560 |
| 4,073,176 | | 2/1978 | Paul | 72/328 |
| 4,098,161 | | 7/1978 | Bloch | 83/519 |

(List continued on next page.)

FOREIGN PATENT DOCUMENTS

| | | |
|---|---|---|
| 73817 | 10/1944 | (CS) . |
| 479885 | 7/1929 | (DE) . |
| 2549281 A1 | 5/1977 | (DE) . |
| 2911614 A1 | 10/1979 | (DE) . |
| 3644743 A1 | 7/1987 | (DE) . |
| 1266350 | 5/1961 | (FR) . |
| 647286 | 10/1962 | (IT) . |
| 58924 | 5/1978 | (JP) . |
| 103250 | 8/1980 | (JP) . |

OTHER PUBLICATIONS

BTM Drawing No. 620000A entitled "50.8mm Bore×50mm Stroke Hand Held Unit w/.18 TL Tooling" having T–slot and offset piston (offered for sale or publicly disclosed around 1991).

GM Drawing No. MSK–722–L, MSK–723–R (BTM Part No. 878600B), entitled "Dual Hole Pierce Unit for CTRL Arm Bracket (Font)" (offered for sale or publicly disclosed around 1996).

BTM Brochure entitled "Press Units for Joining & Piercing", entire brochure, believed to have been published prior to Dec. 15, 1998.

*Primary Examiner*—Kenneth E. Peterson
(74) *Attorney, Agent, or Firm*—Harness, Dickey & Pierce, P.L.C.

(57) ABSTRACT

Disclosed is an automatically equalizing press for sequential operations on opposite sides of a workpiece. The press is designed to allow a pair of punch-anvil combinations to work on opposing sides of the workpiece without substantially deforming the workpiece prior to the final, e.g. piercing, operation. One tool from each combination is mounted on a slide block which is capable of movement independent of the other slide block. The slide blocks are operable by fluid actuated pistons.

23 Claims, 5 Drawing Sheets

U.S. PATENT DOCUMENTS

| | | | | |
|---|---|---|---|---|
| 4,267,753 | * | 5/1981 | Bennet . | |
| 4,397,175 | | 8/1983 | Shear | 72/453.02 |
| 4,419,878 | | 12/1983 | Füsser | 72/455 |
| 4,442,694 | | 4/1984 | Füsser et al. | 72/453.01 |
| 4,523,516 | | 6/1985 | Foster et al. | 92/130 |
| 4,713,592 | * | 12/1987 | Memmel | 318/565 |
| 4,716,803 | | 1/1988 | Waltonen | 83/529 |
| 4,750,408 | | 6/1988 | Stoll | 92/51 |
| 4,763,550 | | 8/1988 | Waltonen et al. | 83/191 |
| 5,076,090 | * | 12/1991 | Cetnarowski | 83/639.5 X |
| 5,440,912 | * | 8/1995 | Copeman . | |

* cited by examiner

AUTO EQUALIZED DUAL PIERCE UNIT

BACKGROUND OF THE INVENTION

Certain manufacturing processes call for operations on two legs of a single piece such as a workpiece having a U-shaped cross-section. The operations are designed to be along a common axis going through that U cross-section. Due to tolerances in the part, as well as the stiffness of the part, the machinery is designed to bring the tools in contact with each leg without deforming the leg prior to the operation, e.g. piercing. A variety of machinery or presses have been devised to alleviate some of the problems encountered in this area. That machinery has included various cylinder and piston combinations for moving opposed tooling against a central workpiece. This tooling, however, suffers from several drawbacks. Among the drawbacks are that the mechanisms for producing sufficient force for the piercing operations are not collinear with the tools themselves, e.g. the punches and anvils. Thus, as more forces are produced, the tools are subject to greater forces which can cant or cock the tooling relative to the desired line of operation. This results in greater tool wear with concomitant reduced tool life, as well as poorer performance due to inaccurate tool alignment, etc. Efforts to reduce some of the problems with unbalanced forces have been countered with larger more massive tools to resist the forces. This, however, can be self defeating in that the tools have to fit within limited space in the factory environment.

SUMMARY OF THE INVENTION

The present invention concerns tooling for operations, e.g. punching, on legs of a U-shaped workpiece whereby the tools, e.g. the punches and anvils, are autoequalized so that the punch will first contact the part, then will actuate anvil (die) into or towards the workpiece to prevent deformation of the workpiece prior to the operation itself. The tooling then allows the sequential operation on the other leg of the workpiece in a similar manner.

One component of the tooling, e.g. either punches or anvils, are mounted on independently reciprocal slide blocks. One of the slide blocks is actuated by fluid pressure against a connective portion. A certain amount of travel of the slide block will result in sufficient force to overcome a mechanical resistor, e.g. a spring, and cause the other component of tooling to draw closer to the first set of tooling. For example, movement of a punch mounted on a slide block will, at a point in travel, cause sufficient force to be generated to cause an anvil mounted on the tooling to travel towards the punch. The resistance of the spring and relative location of the punch and anvil are selected so that the punch and anvil arrive sequentially at the workpiece. The resistance is selected, however, so that the tool that first contacts the workpiece does not substantially deform the workpiece prior to the complementary tool contacting the workpiece. The independently reciprocating slide blocks are mounted within a T-slot of the tooling to resist canting forces generated by the non-collinear systems.

Among the advantages of the present invention are a more compact unit that better resists torquing or canting forces caused by non-collinear pistons with less resultant wear and higher accuracy. Further features and attributes of the present invention are explained in greater detail below.

DETAILED DESCRIPTION OF THE PREFERRED EMBODIMENT

Figure 1:
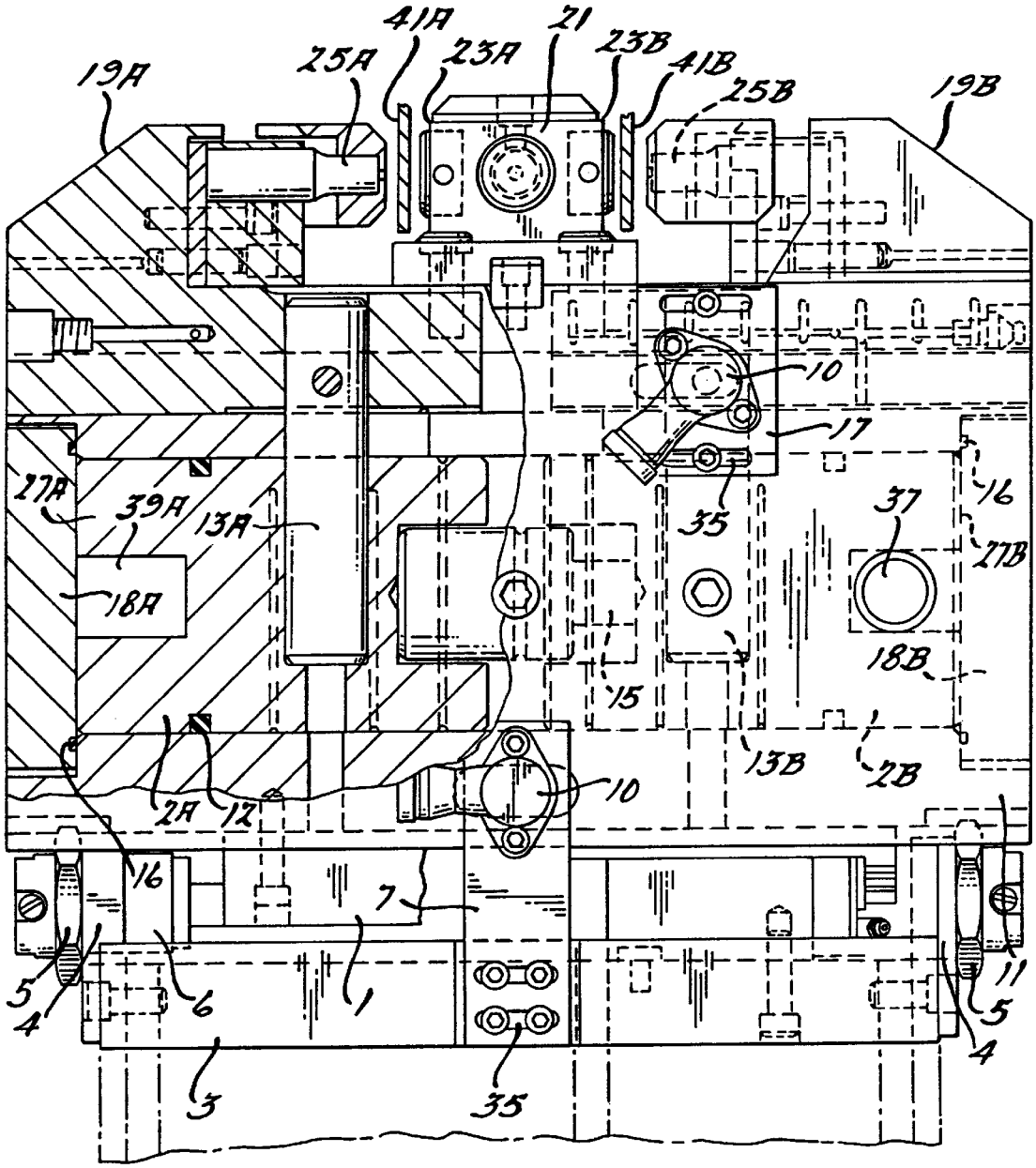
FIG. 1 is a side view of the dual pierce punch of the present invention with a representative workpiece in a centered position.

Turning to FIG. 1, Base 3 is designed to be secured to the factory environment so as to properly locate the press to the workpiece. Base 3 may be mounted directly to a fixture station or mounted through an adaptor plate (not shown) such as when replacing a pre-existing piece of equipment.

Upon the base is mounted cylinder body 11. The cylinder body is mounted for reciprocal movement along a single axis relative to base 3. When viewing FIGS. 1, 3, 4, 5 and 6, that axis would be Left to Right (and vice versa) on the page. Cylinder body 11 may be mounted via track rails 9 (FIG. 2) utilizing roller, ball, or other bearings as known to one of ordinary skill in the art. Preferably two track rails 9 containing bearings are used. The track rails 9 should be displaced towards the outer edges of the cylinder body 11. Mounted centrally underneath the cylinder body 11 is an equalizer bar 1. The equalizer bar 1 runs coaxial with the axis of movement of the cylinder body 11. The equalizer bar 1 is integral with the cylinder body 11, either being formed as one piece or rigidly attached.

On either end of the equalizer bar 1 is a spring 6 attached to an equalizer bracket 4 which in turn is attached to the base 3. In preferred embodiment, the spring 6 is a nitrogen gas spring. The spring 6 serves to resist or retard the reciprocating movement of the cylinder body 11 and will help return it to center. One advantage of nitrogen springs is that they can be readily tuned to vary resistance. In the preferred embodiment, the nitrogen springs 6 are threaded to the equalizer bracket 4 and locked into proper displacement by jam nut 5.

Mounted at the top of cylinder body 11 is tool post 21. The operation of the press usually involves opposed punch and anvil (anvil will also be referred to in the application as dies). In the preferred embodiment, tool post 21 carries the dies 23 against which punches 25 operate. Conversely, tool post 21 could carry the punches and the slide blocks (discussed infra) in that embodiment would carry the die.

Running the length of cylinder body 11 is a cylinder which is co-axial with the direction of reciprocating movement of the cylinder body. End caps 18A and 18B seal off the ends of the cylinder, O-ring 16 helps ensure a fluid tight seal of the cylinder ends.

Placed within the cylinder are first and second pistons 2A and 2B, respectively. Polypak "B" type seals or piston rings 12 encircle the pistons to help maintain a fluid tight seal during movement within the cylinder. Pistons 2A and 2B are positioned so that the head or face of the piston 27A and 27B are facing towards the end caps 18A and 18B, respectively, of the cylinder. At the back of each of the pistons 2A and 2B and secured with the piston is a pin 13A and B. Pin 13A and B extends upwardly and is rigidly secured to the respective slide block 19A and B. The slide blocks 19A and B carry the complementary tooling 25A and 25B which cooperate with the tooling mounted on centerpost 21.

Figure 2:
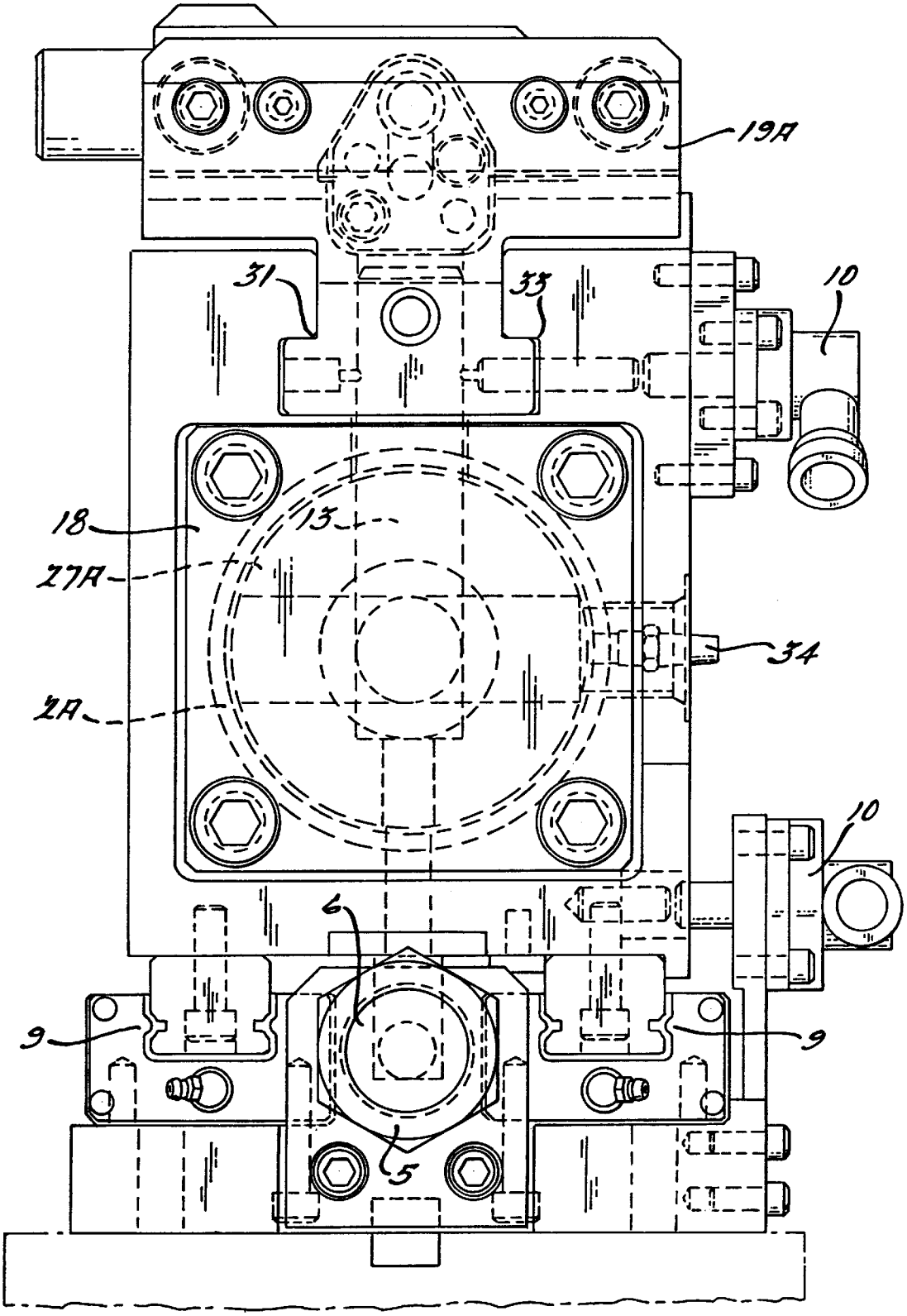
FIG. 2 is a end view of the present invention.

As shown in FIG. 2, slide blocks 19A and B travels in a T-slot 31 which runs the length of cylinder body 11. Slide blocks 19A and B have T-shaped rails 33 to fit within the T-slot to close tolerances. The use of a T-slot close to the center line where the punching actually occurs minimizes play within the tooling and allows the large forces generated during the actual piercing or punching operation to be accommodated on the large surface area of the T-slot. The T-slot allows for sufficient surface area to reduce side-to-side play, as well as play in an up and down direction. There are no bearings placed between the runner 3 of the slide block 19A and B and the T-slot 33, the surfaces themselves doing the bearing, except for conventional lubricant which is supplied to the surfaces on a routine basis.

Between the pistons 2A and 2B within the cylinder of cylinder body 11, a spring 15 such as a nitrogen spring, mechanical spring, or other mechanical resistance unit is placed as shown in FIG. 1. In the preferred embodiment, a nitrogen spring is used. This spring provides a biasing force to return the pistons 2A and 2B towards their rest positions against the respective end caps 18. The spring 15 operates in an environment of atmospheric air. Since the volume of air is subject to being reduced when either piston 2A or 2B travels down the cylinder towards spring 15, muffler 34 (see FIG. 2) provides venting to and from the ambient air from the cylinder during operation of the press.

Proximity switches 10 are mounted on the press. Proximity bracket 7 (FIG. 1) is rigidly secured to the base 3 via bolts. Slots 35 in bracket 7 allows for fine adjustment of the operation of the press once installed. Proximity plates 17 are mounted to the side of cylinder body 11 for further mounting of proximity switches 10. Slots 35 in proximity plates 17 allow for fine adjustment of the placement of the proximity switch, once the press is installed.

Operation of the Press

Figure 4:
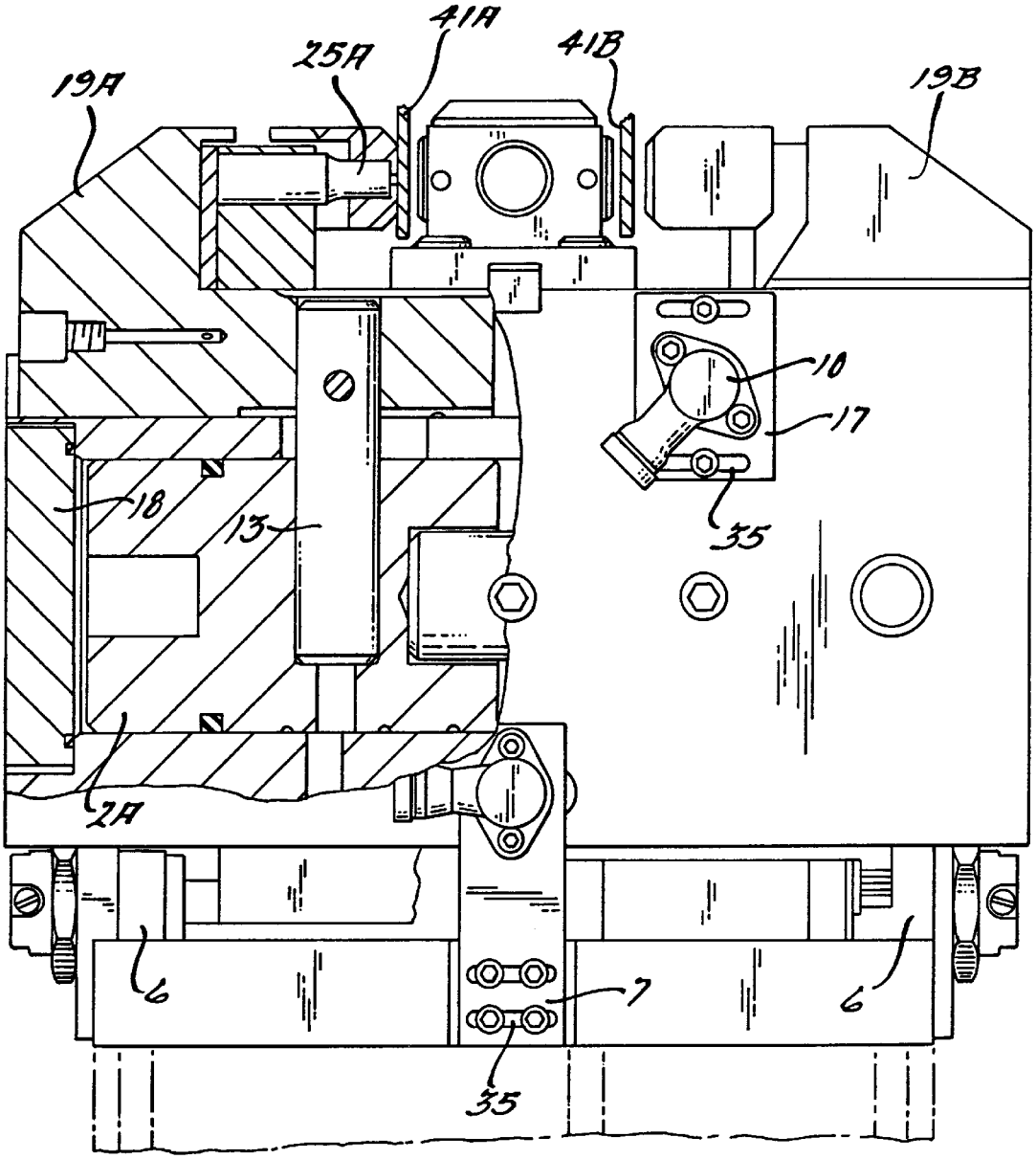
FIG. 4 is a side view of the present invention in cutaway at a first stage of operation.

In a typical use of the press, fluid is supplied under pressure through a fluid access port. In FIG. 1, ref. no. 37 designates the fluid access port for piston 2B. Fluid is supplied to a space between piston 2B and end cap 18B. A similar port (not shown in FIG. 1 due to cutaway) on the left side supplies fluid between piston 2A and end cap 18A. FIG. 1 shows the press at rest, i.e., without fluid pressure. Piston 2A is shown with a recess or counterbore 39A into which fluid initially flows. As additional fluid is supplied, piston 2A begins to move towards the center of the cylinder (to the right in drawings 1, 3, 4 and 6) causing a concomitant movement of pin 1 3A and slide block 1 9A. As a result, tool 25A begins movement towards the tool post 21. This stage of operation is represented by FIG. 4. The tool 25A comes into contact with the workpiece 41A but not with sufficient force to distort the workpiece.

Figure 5:
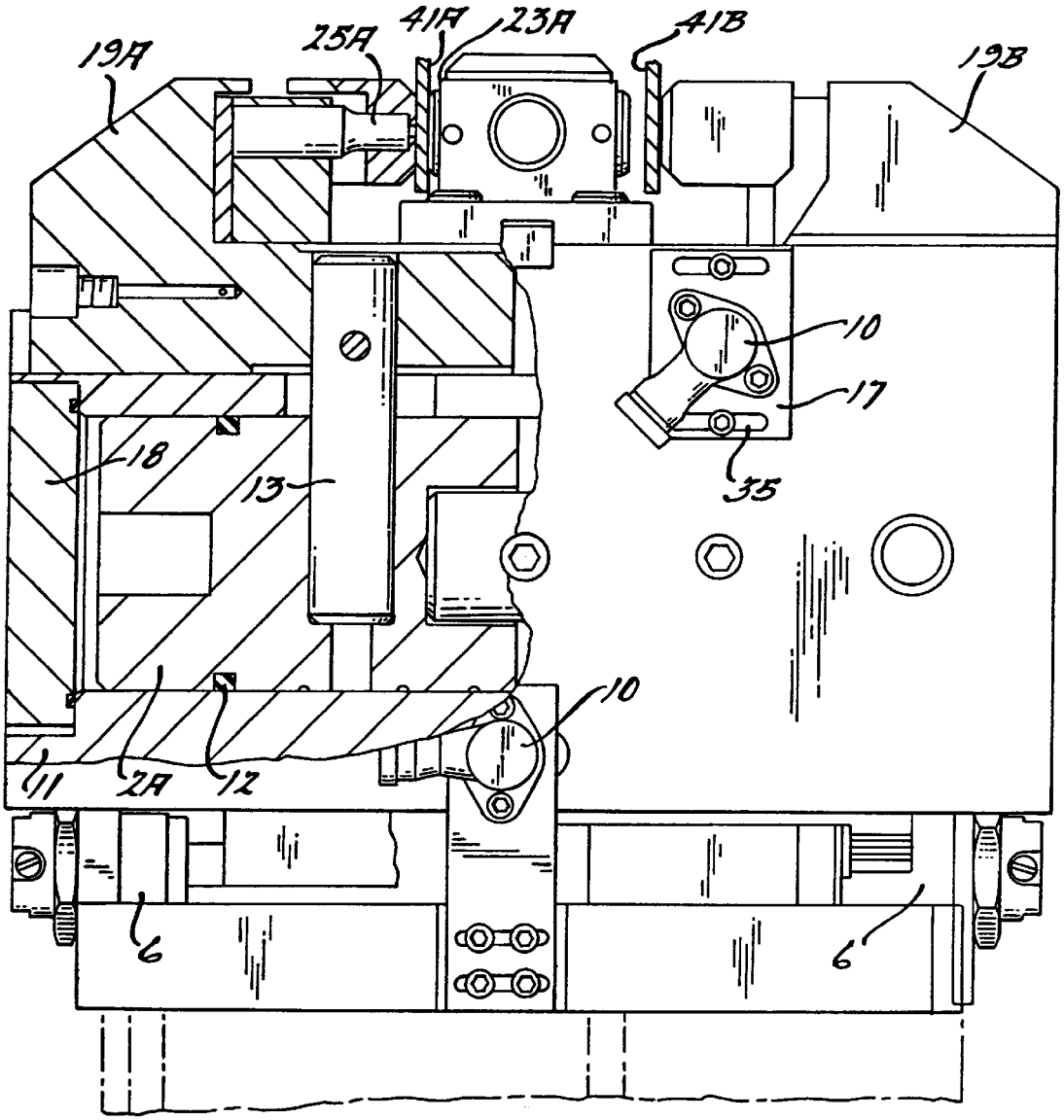
FIG. 5 is a partial cross-sectional view of the invention in a further stage of operation.

Upon movement of piston 2A towards the center of the cylinder, an equal force is acting upon end cap 18A (rigidly secured to cylinder body 11) biasing it to the left in FIGS. 1, 3, 4, 5 and 6. Once the resistant force of nitrogen spring 6 is exceeded, the cylinder body 11 begins to move relative to the base 3 causing the tool post 21 to move towards tool 25A. This stage of operation is shown in FIG. 5. By adjustment of the force rate of spring 6, the press can be adjusted so that tool 25A and the tool on the post 21 do not deform leg 41A of workpiece before the piercing operation. Tool 25A and anvil 23A are against workpiece 41A and supporting it against deformities during the actual piercing operation.

Figure 6:
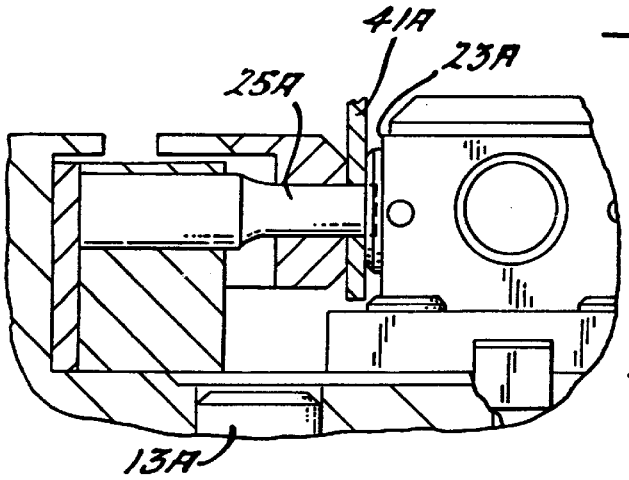
FIG. 6 is a detail of the invention in the piercing operation.

Additional pressure supplied to the space between piston 2A and 18A supplies the force to complete the operation such as the piercing shown in FIG. 6. Proximity switches 10 are adjusted so that once the proper travel of slide block 19A and cylinder body 11 have occurred, the fluid pressure is released. Upon release of the fluid pressure, spring 15 returns the piston 2A and cylinder body 11 to their original centered positions relative to each other and spring 6 returns body 11 to its original position relative to base 3. To pierce the other leg 41B of the workpiece, fluid pressure is supplied between piston 2B and end plate 18B to cause a mirror action movement of the cylinder body 11 and piston 2B and their associated tooling.

Figure 3:
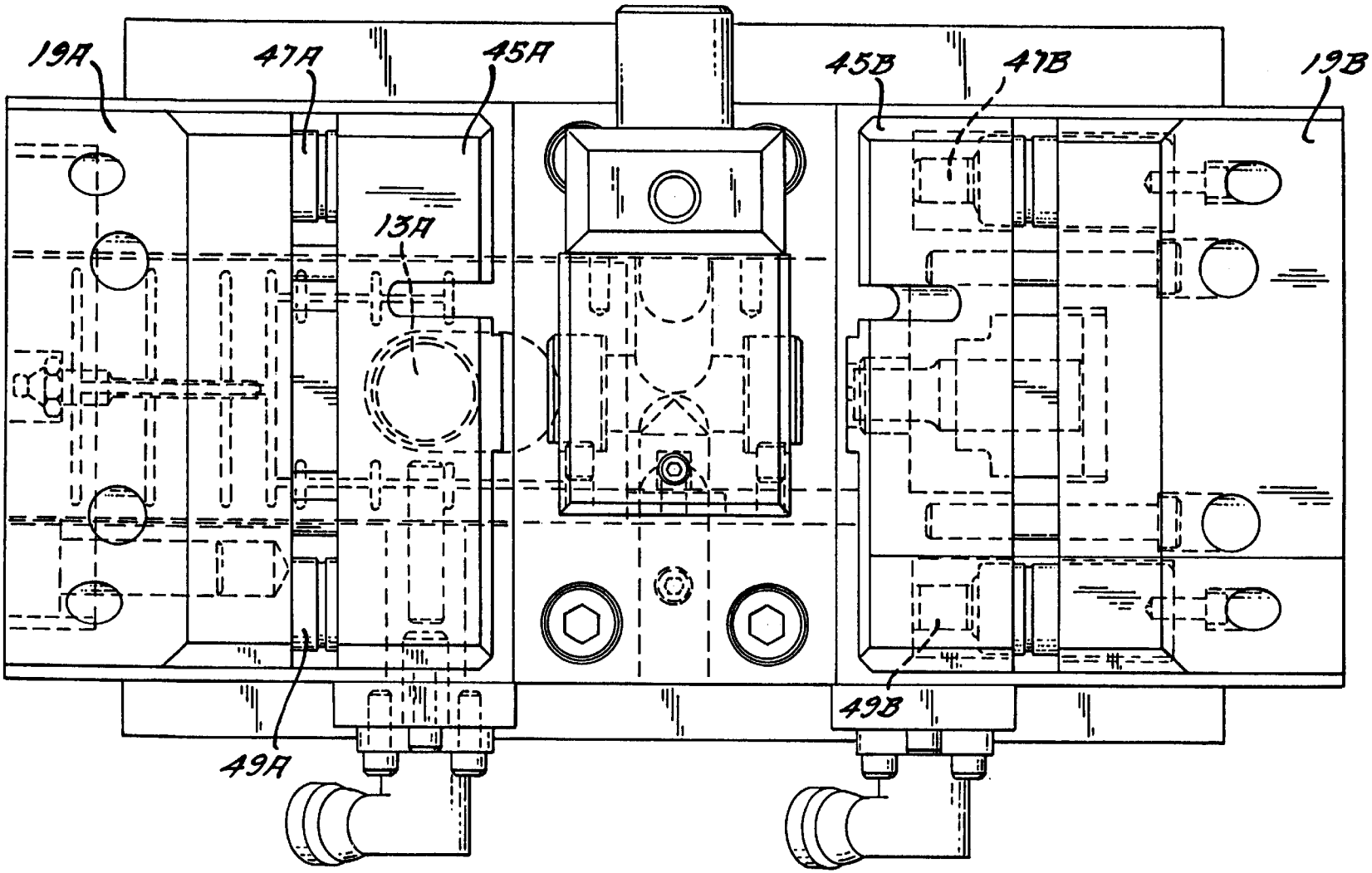
FIG. 3 is a top plan view of the dual pierce punch of the present invention in a partial cutaway in a centered position.

Turning to FIG. 3, the slug removal system is shown. Stripper 45A is compressed during the piercing operation when contacting the workpiece 41A. Upon withdrawal of the punch 25A from workpiece 41A, gas springs 47A and 49A cause bar 45A to extend relative to the punch helping to strip off any slugs and assist in cleaning workpiece 41A.

The result is a compact dual pierce press that is able to bear considerable force along the axis of movement with reduced play and wear resulting in higher accuracy over extended periods of time. Likewise, the press is relatively easy to build, adjust and maintain. The use of independent pistons and slide blocks, in combination with the cylinder body, minimize clearances. Having pistons for both the slide blocks and a single bore also help equalize operation for each side.

What is claimed is:

1. An equalizing press comprising:

a base;

a body mounted on said base operably reciprocating along an axis;

a body tool mounted on said body;

first and second pistons movably located in said body;

first and second slide blocks mounted on said body reciprocally moving in response to movement of said first and second pistons, respectively;

first and second tools mounted on said first and second slide blocks, respectively; and a resistance unit operably allowing limited movement of at least one of said pistons in a first direction along said axis before allowing movement of said body relative to said base in the opposite direction, said resistance unit being located on a line passing through a point located between said first and second tools, said line being perpendicular to said axis;

said resistance unit being located on said axis between said pistons and said body tool being located between said first and second tools.

2. The press of claim 1 wherein said resistance unit is an adjustable spring.

3. The press of claim 1 wherein said resistance unit includes pressurized nitrogen.

4. The press of claim 1 wherein the body has a bore elongated coaxial with said axis, and both of said pistons operably move in said bore.

5. An equalizing press comprising:

a base;

a body mounted on said base operably reciprocating a long an axis;

a body tool mounted on said body;

first and second piston s movably located substantially in said body;

first and second slide blocks mounted on said body reciprocally moving in response to movement of said first and second pistons, respectively;

first and second tools mounted on said first and second slide blocks, respectively; and a resistance unit operably allowing limited movement of at least one of said pistons in a first direction along said axis before allowing movement of said body relative to said base in the opposite direction, said resistance unit being located on said axis between said pistons.

6. The press of claim 5 wherein said first and said second pistons are constrained by being substantially enclosed by a single fluid pressure actuating cylinder in said body.

7. The press of claim 6 further comprising a substantially T-shaped slot, wherein said first and second tools are constrained from non-coaxial movement relative to said body by said substantially T-shaped slot.

8. The press of claim 7 wherein said resistance unit is an adjustable spring.

9. The press of claim 8 wherein said gas is nitrogen and said spring alternately contacts against both of said pistons.

10. The press of claim 5 wherein said resistance unit includes at least one gas spring, and said body is restrained from movement relative to said base by said at least one gas spring coaxially located relative to said pistons.

11. The press of claim 5 wherein said resistance unit includes pressurized nitrogen.

12. The press of claim 5 wherein said resistance unit is an adjustable spring.

13. The press of claim 5 wherein said resistance unit includes pressurized nitrogen.

14. The press of claim 5 wherein the body has a bore elongated coaxial with said axis, and both of said pistons operably move in said bore.

15. An equalizing press comprising:

a base;

a body coupled to said base, said body being movable in a linear manner relative to said base;

a body tool mounted to said body;

a first slide and a second slide;

one of (a) said body and (b) said slides having a linearly extending slot, the other of (a) said body and (b) said slides having a projection with a substantially perpendicular flange, said flange slidable interlocking with said slot;

a first piston located in said body, said first piston being coupled to said second slide;

a second piston located in said body, said pistons being coaxially aligned, said second piston being coupled to said second slide;

a first tool mounted on said first slide and a second tool mounted on said second slide; and a biasing unit located substantially between and biasing against said pistons;

wherein pressure operably applied against said first piston causes said body to linearly move relative to said base while simultaneously causing one of said tools to advance toward another of said tools.

16. The press of claim 15 wherein said projection and said flange define a T-cross sectional shape and said slot has a matching T-cross sectional shape.

17. The press of claim 15 wherein said biasing unit is a gas filled spring contacting against at least one of said pistons.

18. The press of claim 17 wherein said gas is nitrogen and resistance force of said biasing unit is adjustable.

19. The press of claim 15 further comprising a first end cap and a second end cap, said end caps being located at opposite ends of a bore in said body, fluid operably pushing said first piston away from said first end cap and fluid subsequently pushing said second piston away from said second end cap, each of said slides operably moving simultaneously with the respective one of said pistons.

20. The press of claim 15 further comprising a post retaining said body tool, said post being located substantially on a plane passing between adjacent faces of said pistons.

21. The press of claim 20 further comprising:

a second body tool retained by said post;

said first body tool being operable against one leg of a workpiece in concert with said first tool, and said second body tool being subsequently operable against a second leg of the workpiece which is substantially parallel to the first leg in concert with said second tool.

22. The press of claim 20 wherein said plane also passes through said biasing unit.

23. The press of claim 15 wherein said first tool is located on a first plane perpendicular to an advancing direction of said first piston, said first plane extends through said first piston, said second tool is on a second plane parallel to said first plane, and said second plane extends through said second piston.

* * * * *

UNITED STATES PATENT AND TRADEMARK OFFICE

CERTIFICATE OF CORRECTION

PATENT NO. : 6,237,458 B1
DATED : May 29, 2001
INVENTOR(S) : Glenn M. Dennison et al.

It is certified that error appears in the above-identified patent and that said Letters Patent is hereby corrected as shown below:

Title page,
Item [56], OTHER PUBLICATIONS, "(Font)" should read -- (Front) --.

Column 3,
Line 11, delete "3".
Line 48, "1 3A" should be -- 13A --.
Line 48, "1 9A" should be -- 19A --.

Column 4,
Lines 60 and 61, "a long" should be -- along --.
Line 63, "piston s" should be -- pistons --.

Column 6,
Line 48, the following claims should be added:
24. The press of claim 19 wherein said body tool is mounted between said first slide and said second slide.

25. The press or claim 19 wherein said first and second slide are capable of independent coaxial movement.

26. The press of claim 19 wherein said body reciprocally moves along bearings mounted to said base.

27. The press of claim 19 wherein said bias element comprises a coaxial nitrogen spring.

Signed and Sealed this

Twenty-fourth Day of December, 2002

JAMES E. ROGAN
*Director of the United States Patent and Trademark Office*